US006976865B2

(12) United States Patent
Wu

(10) Patent No.: US 6,976,865 B2
(45) Date of Patent: Dec. 20, 2005

(54) CABLE END CONNECTOR ASSEMBLY HAVING PULL MECHANISM

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 34 days.

(21) Appl. No.: 10/829,062

(22) Filed: Apr. 20, 2004

(65) Prior Publication Data

US 2005/0233631 A1 Oct. 20, 2005

(51) Int. Cl.[7] ..... H01R 13/627
(52) U.S. Cl. ..... 439/352; 439/358; 439/483
(58) Field of Search ..... 439/483, 352, 439/358, 357, 578, 456, 459

(56) References Cited

U.S. PATENT DOCUMENTS 6,186,819 B1 * 2/2001 Holub ..... 439/358
6,346,002 B1 * 2/2002 Hsu et al. ..... 439/358
6,565,383 B1 5/2003 Wu
6,585,536 B1 7/2003 Wu
6,585,537 B1 7/2003 Lee
6,655,979 B1 12/2003 Lee
6,692,286 B1 * 2/2004 De Cet ..... 439/352
6,821,139 B1 * 11/2004 Wu ..... 439/352
6,830,472 B1 * 12/2004 Wu ..... 439/358

* cited by examiner

*Primary Examiner*—Gary Paumen
(74) *Attorney, Agent, or Firm*—Wei Te Chung

(57) ABSTRACT

A cable end connector assembly (100) includes an insulative housing (1), a plurality of contacts (3) received in the housing, a cable (4) terminated to the contacts, a cover (2) over-molded with the housing and the cable and defining a channel (214, 218) therein, and a pull mechanism (6). The pull mechanism includes a locking member (60) and a pull tape (62). The locking member includes a retaining portion (600) secured with the insulative housing, a supporting portion (603) engaged with the cover, a pressing portion (602) between the retaining portion and the supporting portion, and a pair of latch portions (6010) located close to the retaining portion. The pull tape is assembled to the pressing portion and extends through the channel away from a rear end of the cover. When the pull tape is rearwardly pulled, the pressing portion of the locking member moves toward the cover correspondingly and the latch portions downwardly moves consequently.

2 Claims, 6 Drawing Sheets

CABLE END CONNECTOR ASSEMBLY HAVING PULL MECHANISM

CROSS-REFERENCE TO RELATED APPLICATIONS

This application is related to U.S. Pat. No. 6,830,472 issued Dec. 14, 2004 and entitled "CABLE END CONNECTOR ASSEMLBY WITH LOCKING MEMBER", U.S. Pat. No. 6,821,139 issued Nov. 23, 2004 and entitled "CABLE END CONNECTOR ASSEMLBY HAVING LOCKING MEMBER", U.S. patent application Ser. No. 10/728,614 filed on Dec. 5, 2003 and entitled "CABLE END CONNECTOR ASSEMLBY HAVING LOCKING MEMBER", and U.S. patent application Ser. No. 10/776,111 filed on Feb. 10, 2004 and entitled "CABLE END CONNECTOR ASSEMLBY HAVING LOCKING MEMBER", all of which have the same applicant and assignee as the present invention. The disclosure of these related applications is incorporated herein by reference.

BACKGROUND OF THE INVENTION

1. Field of the Invention

The present invention generally relates to a cable end connector assembly, and more particularly to a right angle cable end connector assembly having a pull mechanism.

2. Description of Prior Art

There exits in the art an electrical connector known as a serial Advanced Technology Attachment (serial ATA) connector which is generally used for disk drives and storage peripherals. Especially, the serial ATA connector according to the serial ATA standard are featured in fewer electrical contacts than other conventional electrical connectors and are relatively tiny in configuration.

Nowadays, not only are processor speeds increasing, but also the amount of space that a computer fits into is shrinking. Therefore, the motherboards or printed circuit boards (PCBs) that hold the electronics and other devices for a computer have limited space. In a computer which may contain multiple hard drives, multiple serial ATA connectors and serial ATA cable assemblies may need to reside on the PCB and occupy the space of the computer. This takes up considerable space, depending on the number of hard disk drives and associated serial ATA connectors. To solve the above mentioned problem, a serial ATA cable end assembly designed in right angle configuration is desired for saving more space and facilitating mating to a complementary receptacle. It is also desirable for the right angle serial ATA cable end connector assembly to have pull mechanism for providing a reliable mechanical and electrical connection with the complementary connector and facilitating withdrawing from the complementary connector.

Hence, a right angle cable end connector assembly having an improved pull mechanism is desired to overcome the disadvantages of the prior art.

BRIEF SUMMARY OF THE INVENTION

Accordingly, the object of the present invention is to provide a right angle cable end connector assembly having a pull mechanism for locking/unlocking the cable end connector assembly with/from a complementary connector more conveniently.

In order to achieve the above-mentioned object, a cable end connector assembly for use with a mating connector in accordance with the present invention comprises an insulative housing, a plurality of contacts disposed in the insulative housing, a cable terminated to the contacts, an insulative cover, and a pull mechanism. The cover comprises a body portion enclosing a rear end of the housing and a protective sleeve perpendicularly extending from a bottom of the body portion and enclosing joint portions of the cable and the contacts. The body portion defines a channel therein. The pull mechanism comprises a locking member and a pull tape. The locking member comprises at a front end thereof a retaining portion secured with the insulative housing, a supporting portion at a rear end thereof engaged with the cover, a pressing portion formed between the retaining portion and the supporting portion, and a pair of latch portions located at the front end thereof close to the retaining portion and adapted for locking with the complementary connector. The pull tape comprises an interconnecting portion assembled to the pressing portion of the locking member, and a pulling portion connecting with the interconnecting portion and extending through the channel of the cover beyond a rear end of the cover. When the cable end connector assembly is mated with a complementary connector and a rearward pulling force is exerted on the pulling portion of the pull tape, the pressing portion of the locking member is forced to move toward the cover and the latch portions are urged to downwardly move correspondingly, thereby detaching the cable end connector assembly from the complementary connector.

Other objects, advantages and novel features of the invention will become more apparent from the following detailed description of the present embodiment when taken in conjunction with the accompanying drawings.

DETAILED DESCRIPTION OF THE INVENTION

Figure 1:
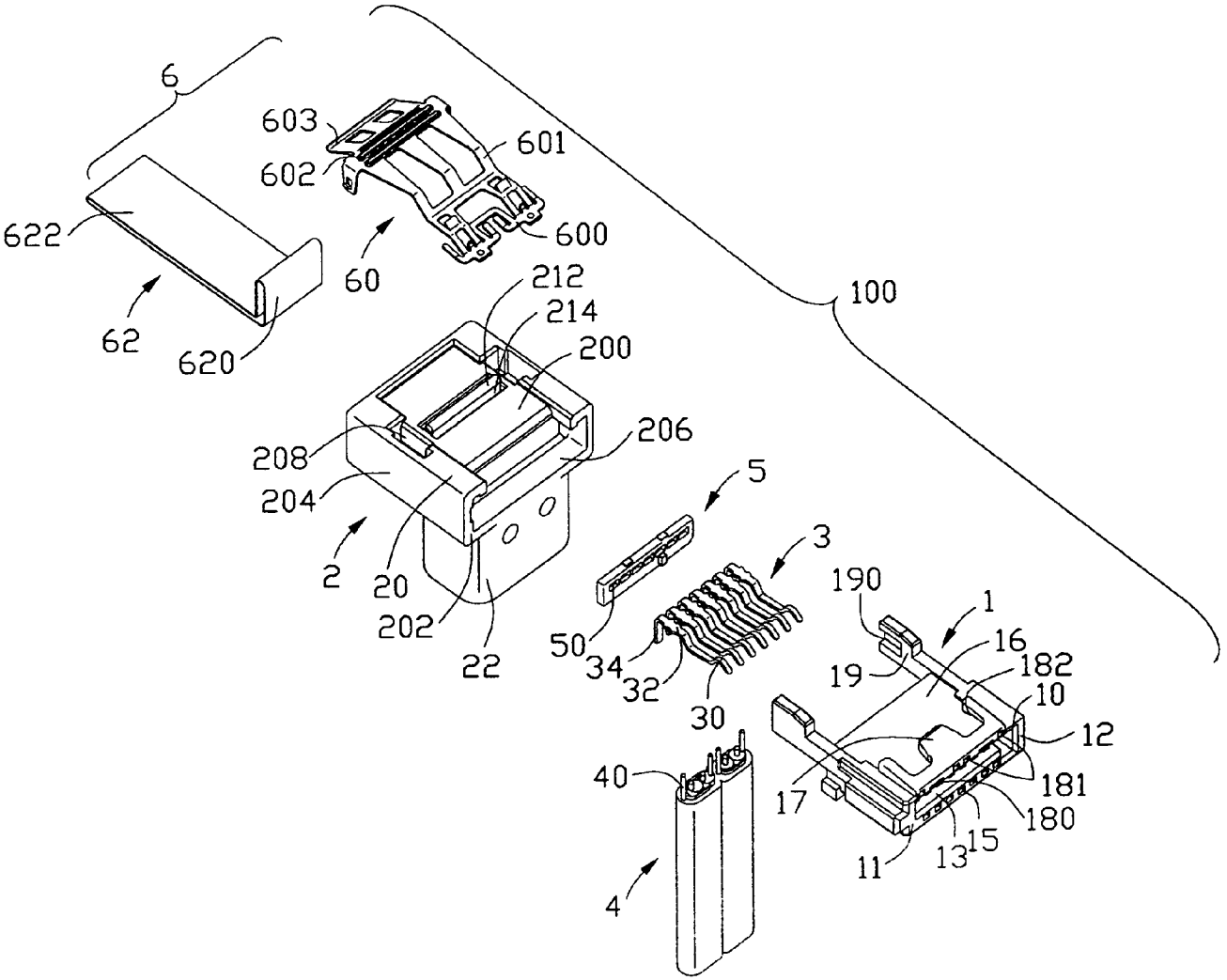
FIG. 1 is an exploded, perspective view of a cable end connector assembly in accordance with the present invention.

Reference will now be made to the drawing figures to describe the present invention in detail.

Figure 2:
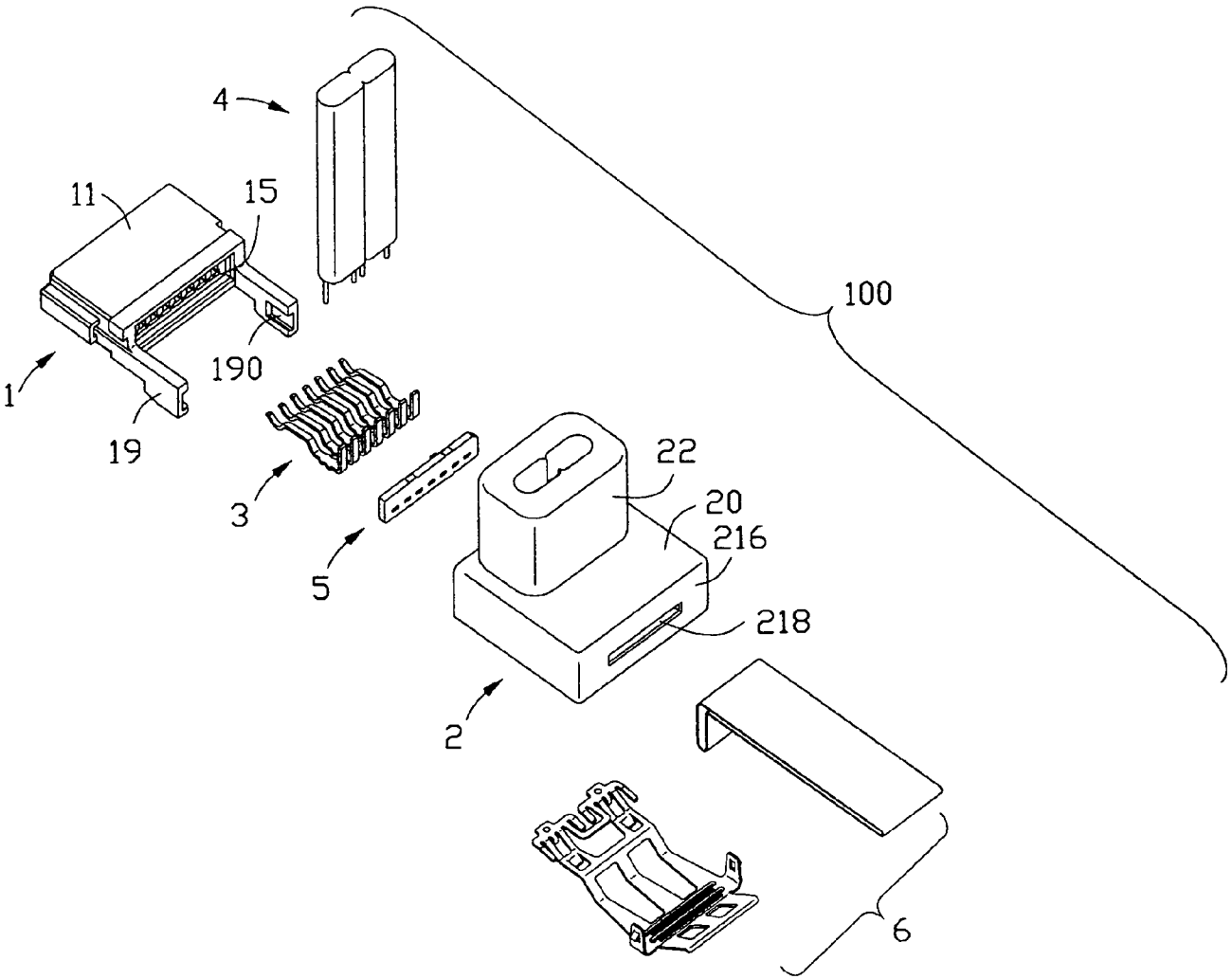
FIG. 2 is a view similar to FIG. 1, but taken from a different aspect.

Referring to FIGS. 1 and 2, a cable end connector assembly 100 in accordance with the present invention comprises an insulative housing 1, a cover 2, a plurality of contacts 3, a cable 4, a spacer 5 and a pull mechanism 6.

Figure 6:
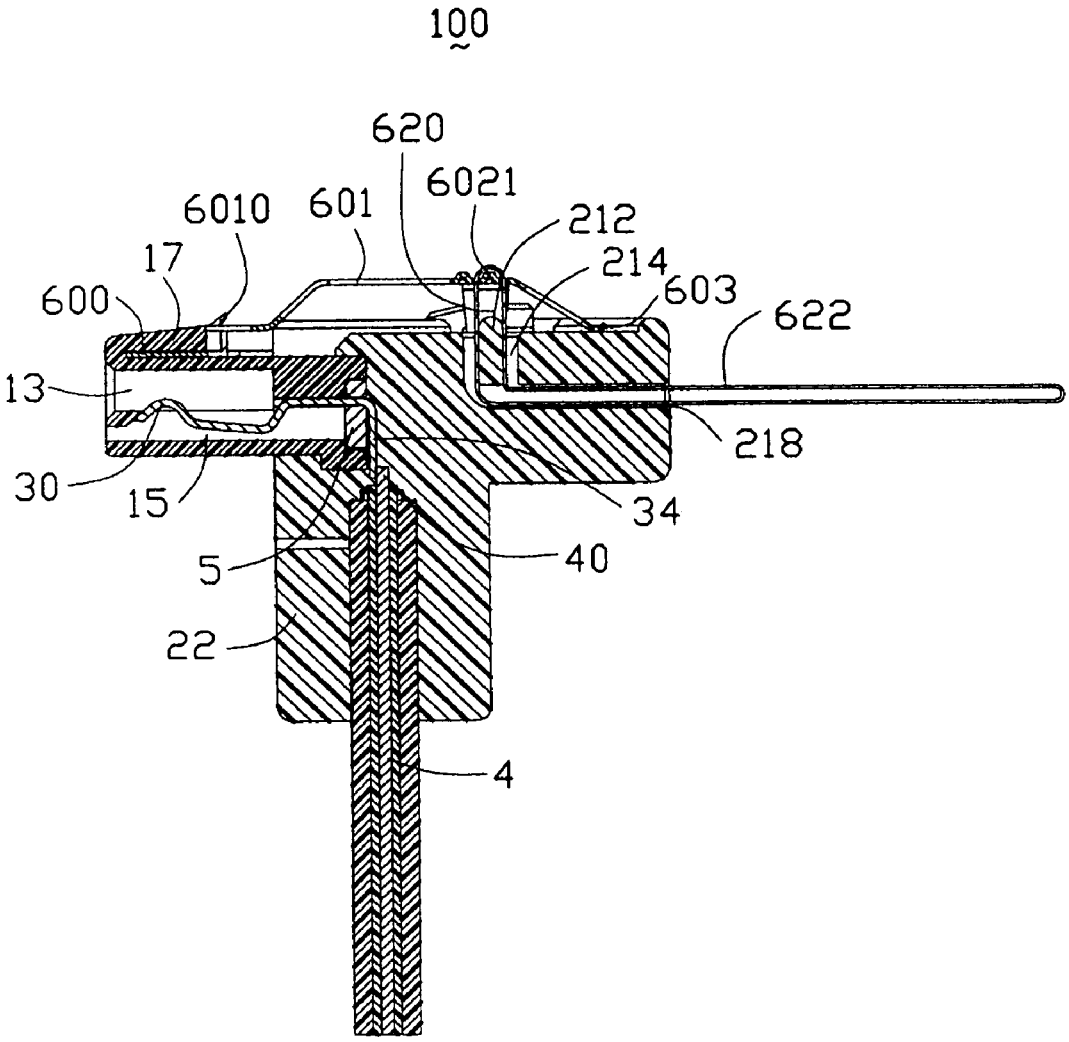
FIG. 6 is a cross-sectional view taken along line 6—6 of FIG. 5.

Referring to FIGS. 1–2 in conjunction with FIG. 6, the insulative housing 1 comprises an upper wall 10, a lower wall 11 opposite to the upper wall 10, and a pair of sidewalls 12 connecting with the upper wall 10 and the lower wall 11. The upper wall 10, the lower wall 11 and the sidewalls 12 together define an L-shaped receiving space 13 therebetween. The lower wall 11 defines a plurality of passageways 15 extending therethrough along a front-to-back direction. The upper wall 10 defines a depression 16 in an upper surface thereof. A flat portion 17 protrudes upwardly and rearwardly from a middle portion of a front flange of the upper wall 10 into the depression 16. A gap 182 is formed between the flat portion 17 and a bottom surface of the depression 16. The upper wall 10 further defines a pair of first slots 180 and two pairs of second slots 181 in communication with the gap 182. A pair of wing portions 19 respectively extend rearwardly from the sidewalls 12. Each wing portion 19 defines a cutout 190 in a rear portion thereof.

The cover 2 comprises a rectangular body portion 20 and a protective sleeve 22 downwardly extending from a bottom of the body portion 20. The body portion 20 is formed with a top wall 200, an opposite bottom wall 202, a pair of side walls 204 parallel extending between the top, the bottom walls 200, 202, and a rear wall 216 connecting the top, the bottom and the side walls 200, 202, 204. A receiving cavity 206 is defined between the top and the bottom walls 200, 202 for receiving a rear end of the insulative housing 1. A pair of passages 208 is defined at opposite sides of the top wall 200 in communication with the receiving cavity 206 for receiving the wing portions 19 of the insulative housing 1 therein. An L-shaped channel is defined in the body portion 20 and consists of a first channel 214 and a second channel 218. The first channel 214 is defined through the top wall 200 in a direction perpendicular to the front-to-back direction, between the passages 208. The second channel 218 is defined along the front-to-back direction through the rear wall 216 and in communication with the first channel 214. The top wall 200 further comprises a holding bar 212 dividing the first channel 214 into two narrow sections.

The contacts 3 are respectively disposed in the passageways 15 of the insulative housing 1. Each of the contacts 3 comprises a curved contact portion 30 exposed in a corresponding passageway 15 of the insulative housing 1, a retention portion 32 engaged with interior sides of the corresponding passageway 15, and a tail portion 34 perpendicularly bent from the retention portion 32.

The cable 4 comprises a plurality of individual conductors 40 for being respectively soldered to the tail portions 34 of the contacts 3.

The spacer 5 is mounted to the rear end of the insulative housing 1 and defines a plurality of through holes 50 only allowing the tail portions 34 of the contacts 3 passing therethrough. The spacer 5 can prevent plastic from seeping into the passageways 15 of the insulative housing 1 during the molding process of the cover 2. The contacts 3 and the spacer 5 can be integrally formed before mounting to the insulative housing 1, if desired.

Figure 3:
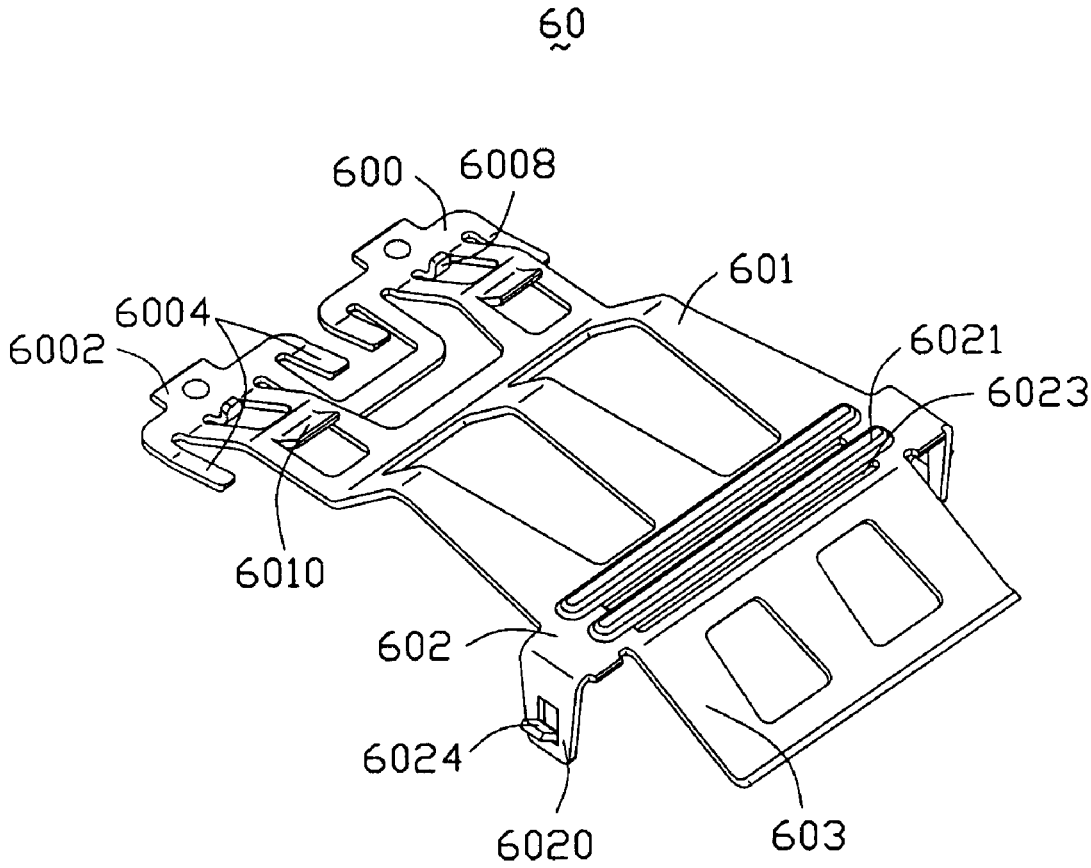
FIG. 3 is an enlarged, perspective view of a locking member shown in FIG. 1.

Particularly referring to FIG. 3, the pull mechanism 6 comprises a locking member 60 and a pull tape 62. The locking member 60 is stamped and formed from a metallic plate and comprises a retaining portion 600, a locking portion 601 extending upwardly and rearwardly from the retaining portion 600, a pressing portion 602 extending rearwardly from the locking portion 601, and a supporting portion 603 extending rearwardly and downwardly from the pressing portion 602. The retaining portion 600 has two pairs of snap tabs 6004 extending rearwardly and upwardly from a front end thereof, a pair of forwardly extending positioning tabs 6002, and a pair of upwardly protruding curved stopping portions 6008. The locking portion 601 has a pair of latch tabs 6010 protruding upwardly and rearwardly therefrom. The pressing portion 602 is formed with two ribs 6021 on a top surface thereof, and a pair of side beams 6020 extending downwardly from opposite ends thereof. The pressing portion 602 defines a pair of grooves 6023 at opposite sides of one rib 6021 along a lengthwise direction thereof. Each side beam 6020 is stamped with a spring tab 6024 extending outwardly therefrom.

In assembly, the individual conductors 40 of the cable 4 are soldered to the tail portions 34 of the contacts 3, and the joint portions thereof are over-molded by the protective sleeve 22 of the cover 2. The body portion 20 of the cover 2 is molded over the wing portions 19 of the insulative housing 1. The wing portions 19 are partially exposed beyond the passages 208 of the cover 2.

Figure 4:
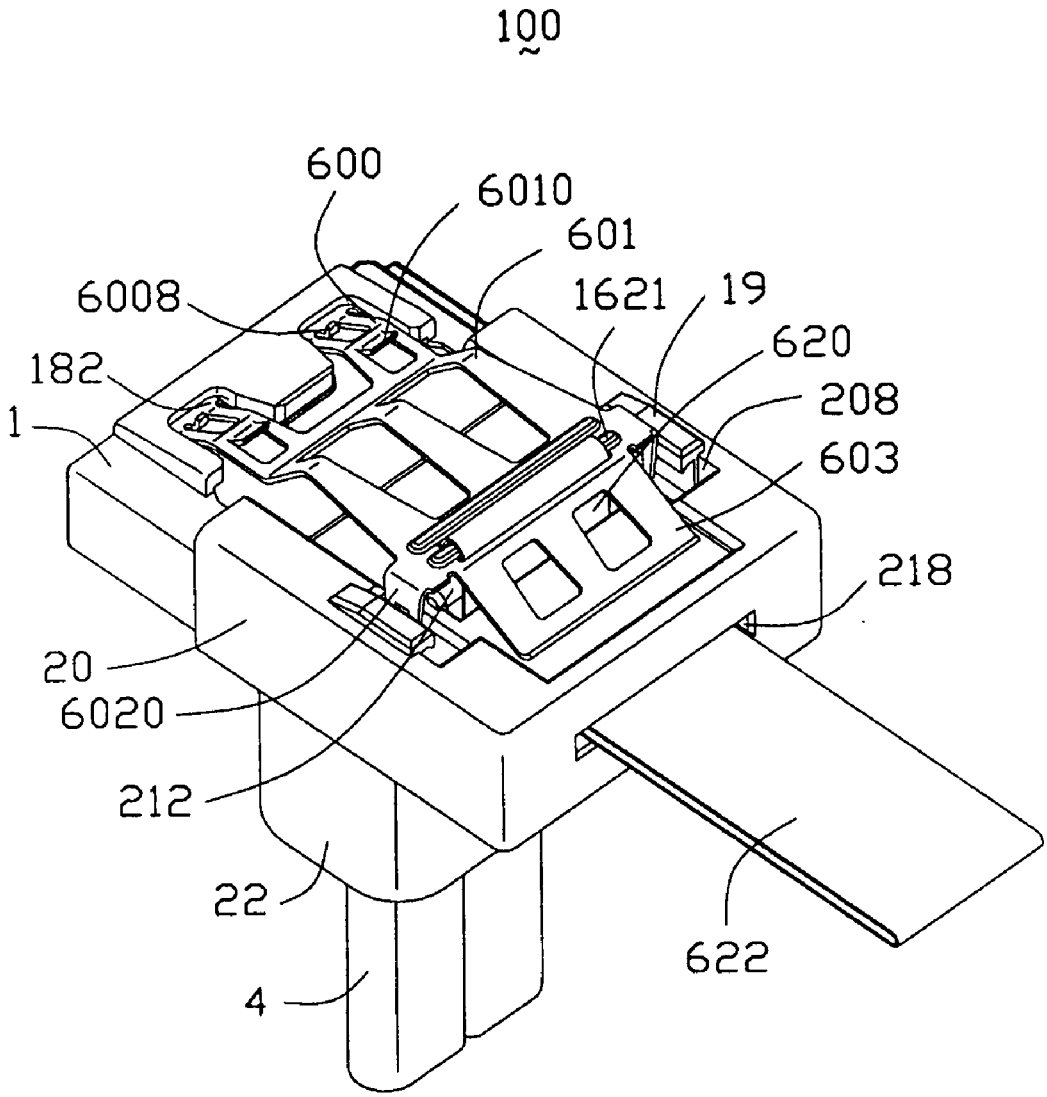
FIG. 4 is an assembled view of the cable end connector assembly shown in FIG. 1.
Figure 5:
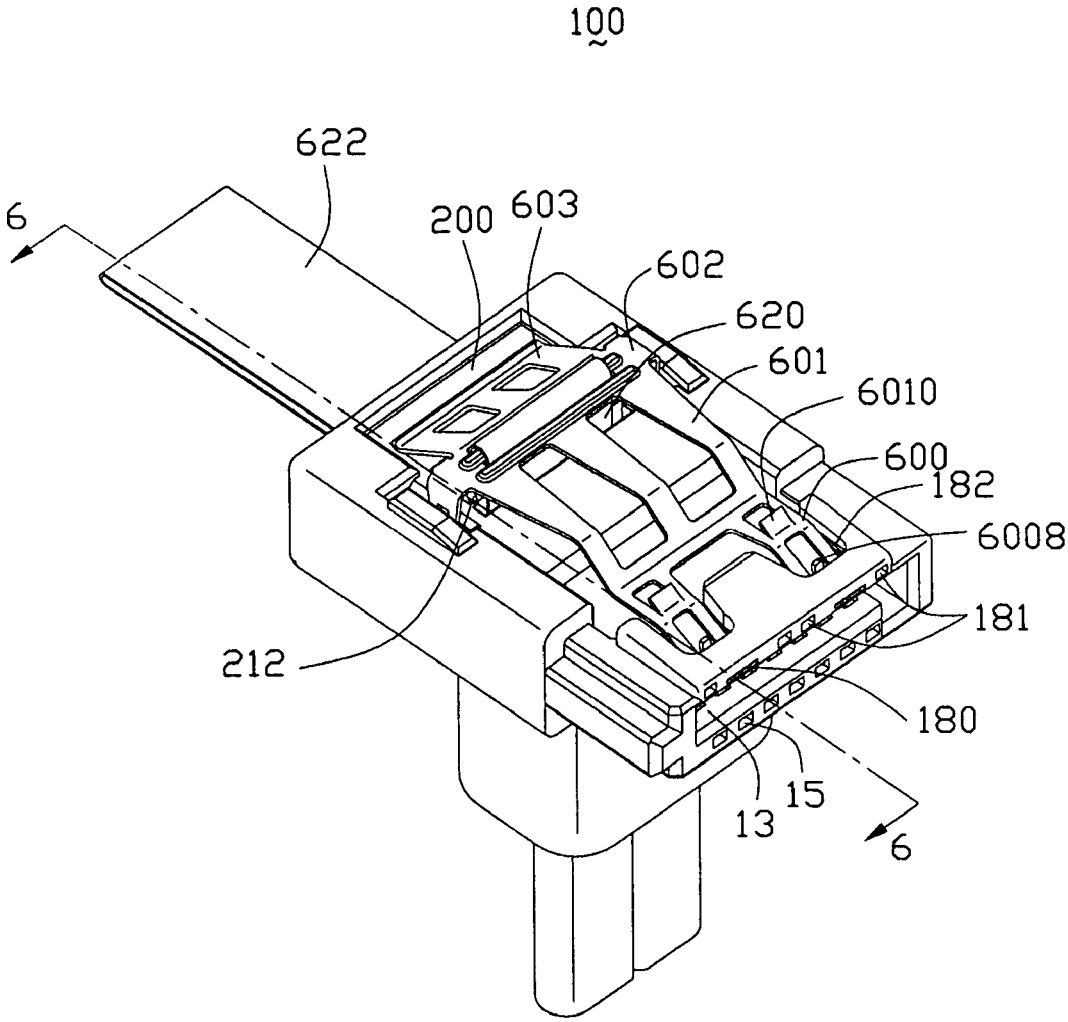
FIG. 5 is a view similar to FIG. 4, but viewed from a different angle.

Particularly referring to FIGS. 4 and 5, the pull mechanism 6 is mounted onto the insulative housing 1 and the cover 2. Firstly, the pull tape 62 is assembled to the cover 2 and the locking member 60. One end of the pull tape 62 firstly extends through the second channel 218 and one section of the first channel 214 from the rear end 216 of the cover 2, stretches away from the top surface of the top wall 200, pass through one groove 6023, wrap the rib 6021, and then pass through another groove 6023, the other section of the first channel 214 and the second channel 218 in turn to overlap the other end of the pull tape 62. Thus, the pull tape 62 is formed with an interconnecting portion 620 assembled to the locking member 60, and a pulling portion 622 extending from the interconnecting portion 620 along the front-to-back direction for pulling by a user. The locking member 60 is then assembled to the cover 2 and the insulative housing 1 under a pressing force, with the side beams 6020 thereof respectively partially inserted into the rear portions of the passages 208 and pushed adjacent to the wing portions 19 of the insulative housing 1, with the positioning tabs 6002 and the snap tabs 6004 of the retaining portion 600 respectively pushed into the gap 182 and received in the corresponding first and second slots 180, 181 of the insulative housing 1, and with the supporting portion 603 abutting against the top surface of the top wall 200. The spring tabs 6024 of the pressing portion 602 are pressed into the cutouts 190 of the wing portions 19 and are slideable therealong.

When the cable end connector assembly 100 is to be mated with a complementary connector in the front-to-back direction, a rearward pulling force is exerted on the pulling portion 622 of the pull tape 62, which forces the pressing portion 602 of the locking member 60 to move downwardly till contacting with the holding bar 212 of the cover 2. Correspondingly, the latch portion 6010 downwardly moves a big enough distance to realize the locking/unlocking between the cable end connector assembly 100 and the complementary connector easily.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. Understandably, one feature of the invention is to provide a pulling device which exerts a rearward force in alignment with the mating port in a front-to-back direction while such a rearward force is partially transformed to a lateral force perpendicular to the front-to-back direction, so as to release the locking device which is moveable in a lateral direction perpendicular to the front-to-back direction.

What is claimed is:

1. A cable end connector assembly comprising:

an insulative housing;

a plurality of contacts disposed in the insulative housing;

a cable comprising a plurality of individual conductors electrically connecting with corresponding contacts;

an insulative cover enclosing a rear end of the housing and joint portions of the conductors of the cable and the contacts, the cover defining a channel therethrough; and a pull mechanism comprising:

a locking member being movably retained to the insulative housing and comprising a pressing portion and a latch portion adapted for locking with a complementary connector; and a pull tape comprising an interconnecting portion assembled to the pressing portion of the locking member, and a pulling portion connecting with the interconnecting portion, the pulling portion passing through the channel of the cover and extending beyond a rear end of the cover, the pulling portion when a rearward pulling force is exerted thereto, moving the pressing portion of the locking member toward the cover to unlock the latch portion from the complementary connector;

wherein the pressing portion of the locking member defines a pair of spaced grooves permitting one end of the pull tape to pass therethrough and wrap a portion therebetween, thereby forming the interconnecting portion of the pull tape;

wherein the pressing portion of the locking member forms a plurality of ribs thereon, and one of the ribs is located between the two grooves;

wherein the cover comprises a body portion enclosing the rear end of the housing and a protective sleeve perpendicularly extending from a bottom of the body portion, the protective sleeve enclosing the joint portions of the conductors of the cable and the contacts, and wherein the channel is defined in the body portion;

wherein the body portion of the cover comprises a top wall, a bottom wall opposite to the top wall, and a rear wall connecting and extending between the upper and the bottom walls, and wherein the channel of the cover consists of a first channel defined through the top wall and a second channel defined through the rear wall in communication with the first channel;

wherein the top wall of the cover forms a holding bar dividing the first channel into two sections, and wherein the pressing portion moves toward the cover until contacting the holding bar when the pull tape is rearwardly pulled;

wherein the pull tape extends away from the cover in a direction perpendicular to that of the cable;

wherein each contact comprises a contact portion, a retention portion rearwardly extending from the contact portion, and a tail portion perpendicularly bent from the retention portion and exposed outside a rear end of the insulative housing;

wherein the insulative housing comprises a pair of wing portions extending rearwardly from a rear end thereof;

wherein each wing portion of the insulative housing defines a cutout, and wherein the pressing portion of the locking member comprises a pair of side beams extending vertically from opposite ends thereof, each side beam forms a spring tab engaged in the cutout of the wing portion;

wherein the locking member comprises a retaining portion at a front end thereof secured to the insulative housing and a supporting portion at a rear end thereof secured to the cover, the pressing portion is formed between the retaining portion and the supporting portion, the latch portion is located close to the retaining portion;

wherein the insulative housing defines a gap receiving the retaining portion of the locking member;

wherein the insulative housing defines a first slot communicating with the gap, and wherein the retaining portion of the locking member forms a positioning tab extending forwardly from a front end thereof and being receiving within the first slot;

wherein the insulative housing defines a second slot communicating with the gap, and wherein the retaining portion of the locking member forms a snap tab extending rearwardly from the front end and being received with the second slot.

2. A cable end connector assembly comprising:

an insulative housing defining a forward mating portion;

a plurality of contacts disposed in the housing and in communication with the mating port;

a cable including a plurality of conductors electrically connected to the corresponding contacts, respectively;

a cover enclosing at least a portion of one of said housing and said cable;

a locking member associated with at least one of said cover and said housing and defining at least one laterally extending latch tab perpendicular to a front-to-back direction of the housing; and a pull device associated with at least one of said cover and said housing; wherein said pull device generates a rearward force which is partially transformed to another force along a first lateral direction generally perpendicular to said front-to-back direction so as to actuated said latch tab to move in a second lateral direction for releasing a complementary connector which is mated with the mating port;

wherein said first lateral direction is the same as the second lateral direction;

wherein said cable extends in a third lateral direction perpendicular to said front-to-back direction;

wherein said rearward force is essentially aligned with said mating portion in said front-to-back direction;

wherein said pull device is directly connected to the locking member.

* * * * *